US006099437A

United States Patent [19]

DeMers

[11] Patent Number: 6,099,437

[45] Date of Patent: Aug. 8, 2000

[54] EXERCISE APPARATUS

[76] Inventor: Travis G. DeMers, 4001 S. Hazelton La., Tempe, Ariz. 85282

[21] Appl. No.: 09/204,873

[22] Filed: Dec. 3, 1998

[51] Int. Cl.[7] ..... A63B 23/14

[52] U.S. Cl. ..... 482/46

[58] Field of Search ..... 482/44–45, 46–49, 482/50

[56] References Cited

U.S. PATENT DOCUMENTS

| | | | |
|---|---|---|---|
| D. 264,237 | 5/1982 | McCaleb et al. | D21/198 |
| 1,982,843 | 12/1934 | Traver | 482/70 |
| 2,475,656 | 7/1949 | Bidak . | |
| 3,740,033 | 6/1973 | Kamp | 272/79 |
| 3,806,121 | 4/1974 | Crossley . | |
| 3,982,755 | 9/1976 | Sarich . | |
| 4,438,920 | 3/1984 | Veillette . | |
| 5,037,087 | 8/1991 | Roth | 272/117 |
| 5,547,441 | 8/1996 | Mora . | |
| 5,620,398 | 4/1997 | Moriarty . | |

*Primary Examiner*—Stephen R. Crow
*Assistant Examiner*—Jayne M Saydah
*Attorney, Agent, or Firm*—Parsons & Goltry; Michael W. Goltry; Robert A. Parsons

[57] ABSTRACT

Exercise apparatus comprising an elongate body, a weight supported by a lanyard depending from the elongate body, and first and second stops carried by the elongate body each in substantially abutting relation against one of either side of the lanyard, wherein a user may grasp and rotate the elongate body to raise and lower the weight as the lanyard is wound and unwound about the elongate body with the first and second stops cooperating to force the lanyard to wind and unwind about the elongate body upon itself.

17 Claims, 2 Drawing Sheets

34
30
33
10
32
31
35
14
33A
13
15
22
32A
29
16
12
18
19
42
17
43
40
11
41

31
33
23
22
24
25
10
26
13

16
17
12
43
42
40
11

10
13
33
27
31
12
28
22

EXERCISE APPARATUS

FIELD OF THE INVENTION

This invention relates generally to exercise devices and, more particularly, to exercise apparatus and methods for strengthening the wrists, arms and shoulders.

BACKGROUND OF THE INVENTION

Strength training is arguably the best way to develop musculature and to strengthen and increase the density of the skeletal system. Commercial gymnasiums offer people free weights and a wide variety of equipment designed for isolating particular muscle groups. Gym memberships can be prohibitively expensive for some people. As a result, the fitness industry provides people with a wide variety of exercise apparatus that may be purchased inexpensively and used in the home for strength training.

In this regard, skilled artisans have devoted considerable effort toward inexpensive devices for strengthening the hands, wrists, arms and shoulders that may purchased and used easily in the home. These devices generally include a weight supported by a lanyard carried by a handled body. A user may grasp and rotate the handled body to raise and lower the weight as the lanyard is wound and unwound about the elongate body. By holding such a device outwardly away from the body during use, it proves particularly advantageous for strengthening the muscles of the hands, wrists, forearms, upper arms and shoulders. Although the various prior art embodiments of these devices prove exemplary for intended use, they suffer from specific structural shortcomings that can occasion injury and interfere with comfort and ease of use.

Accordingly, it would be highly desirable to provide improved exercise apparatus and methods for strengthening the hands, wrists, arms and shoulders.

It is a purpose of the present invention to provide new and improved exercise apparatus that is easy to construct.

It is another purpose of the present invention to provide new and improved exercise apparatus that is easy to use.

It is still another purpose of the present invention to provide new and improved exercise apparatus that is inexpensive.

It is a further purpose of the present invention to provide new and improved exercise apparatus that provides users with a balanced weight throughout a range of exercise movement.

It is still a further provision of the present invention to increase the ease and efficiency of strengthening the muscles of the hands, wrists, arms and shoulders.

It is yet still a further provision of the present invention to provide new and improved exercise apparatus that substantially minimizes the risk of injury associated with strengthening the muscles of the hands, wrists, arms and shoulders.

SUMMARY OF THE INVENTION

The above problems and others are at least partially solved and the above purposes and others realized in new and improved exercise apparatus for strengthening the muscles of the hands, wrists, arms and shoulders. In a specific embodiment, exercise apparatus of the present invention comprises an elongate body, a weight supported by a lanyard depending from the elongate body, and first and second stops carried by the elongate body each in substantially abutting relation against one of each side of the lanyard. In operation, a user may grasp, such as with one or more of his or her hands, and rotate the elongate body to raise and lower the weight as the lanyard is wound and unwound about the elongate body with the first and second stops cooperating to force the lanyard to wind and unwind about the elongate body upon itself. The first and second stops define opposing abutting surfaces that face and substantially abut the lanyard. The elongate body includes handles each located on either side of one of the first and second stops.

BRIEF DESCRIPTION OF THE DRAWINGS

The foregoing and further and more specific objects and advantages of the instant invention will become readily apparent to those skilled in the art from the following detailed description thereof taken in conjunction with the drawings in which.

DETAILED DESCRIPTION OF A PREFERRED EMBODIMENT

The present invention provides, among other things, new and improved exercise apparatus and methods for strengthening the muscles of the hands, wrists, forearms, upper arms and shoulders. Ensuing embodiments are easy and inexpensive to construct, easy to use and provide users with the ability to exercise safely and efficiently.

Figure 1:
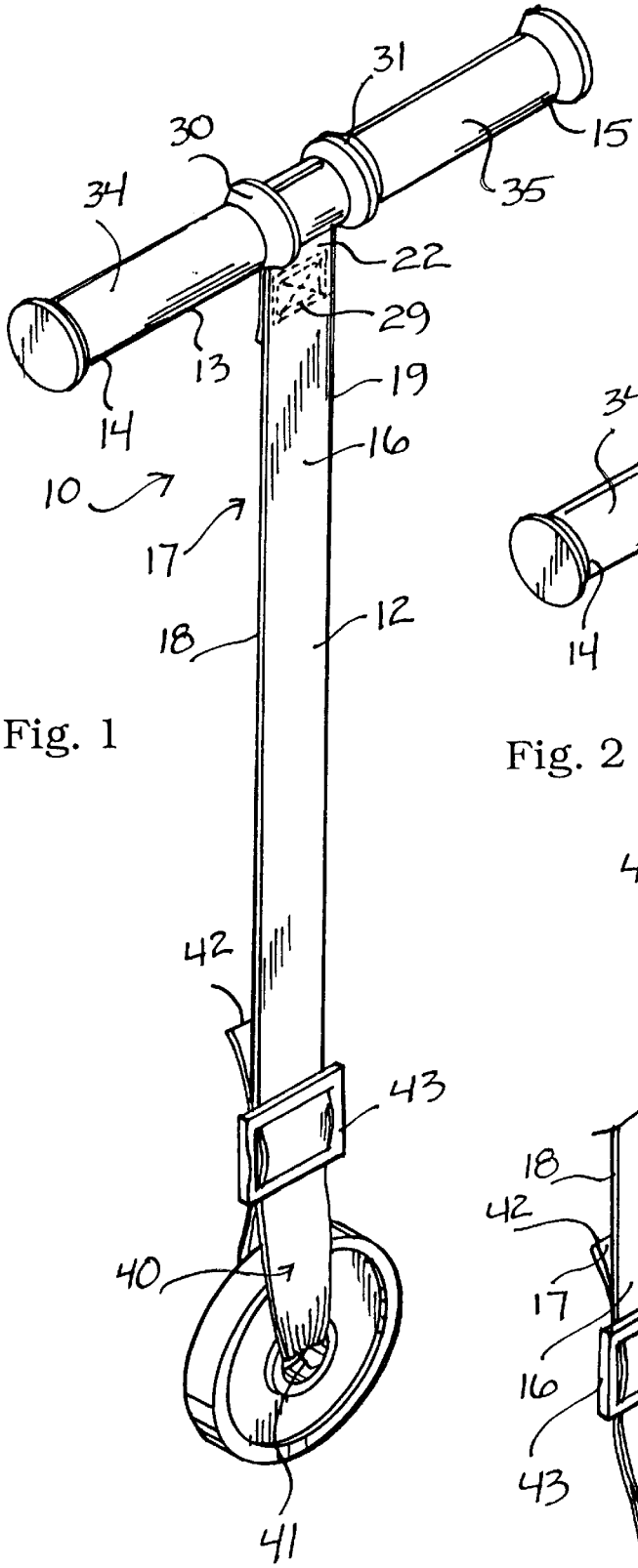
FIG. 1 is an isometric view of exercise apparatus comprising a weight carried by a lanyard supported by an elongate body.
Figure 2:
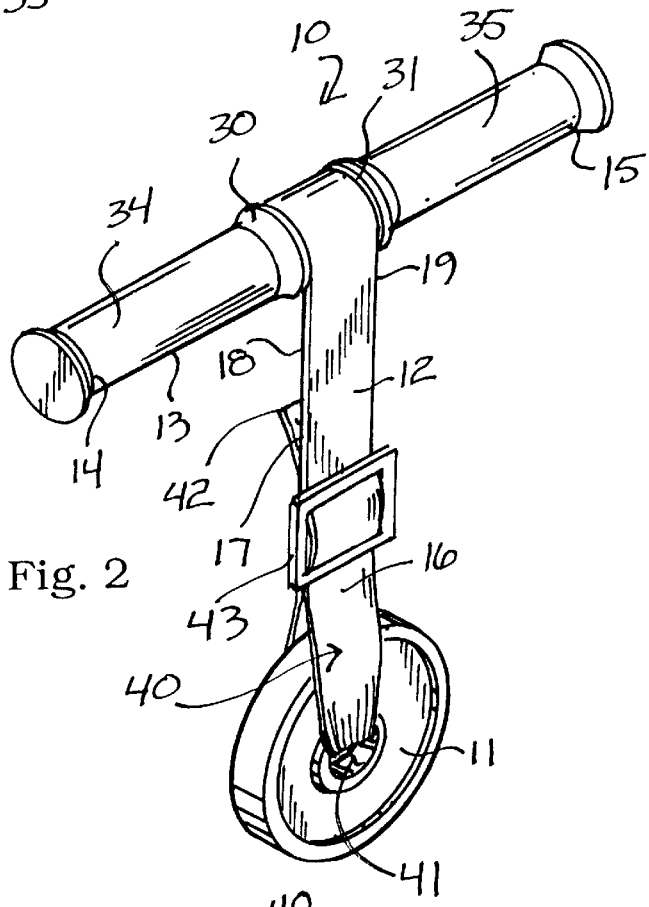
FIG. 2 is another isometric view of the exercise apparatus of FIG. 1 with the lanyard shown as it would appear in a wound condition about the elongate body.
Figure 3:
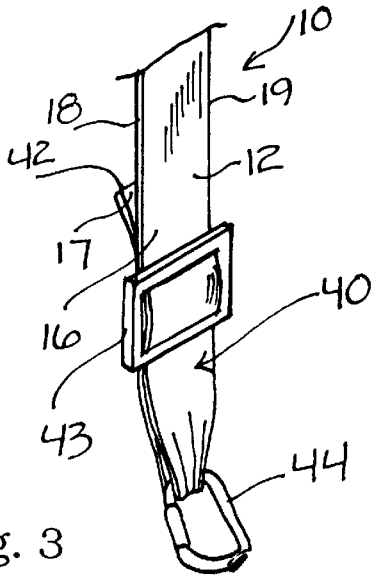
FIG. 3 is a fragmented isometric view of the lanyard of FIG. 1 shown as it would appear supporting a carabiner.

Turning now to the drawings, in which like reference characters indicate corresponding elements throughout the several views, attention is first directed to FIGS. 1 and 2 which illustrate isometric views of exercise apparatus 10 comprising a weight 11 carried by a lanyard 12 supported by an elongate body 13 that a user may grasp and rotate to raise and lower weight 11 as lanyard 12 is wound and unwound about elongate body 13 or otherwise moved between wound and unwound conditions. Elongate body 13 is substantially cylindrical and includes first and second free ends, 14 and 15. Lanyard 12 depends from elongate body 13 intermediate first and second free ends 14 and 15, and, more particularly, at a point substantially equidistant from first and second free ends 14 and 15. Lanyard 12 is constructed of canvass, nylon or other substantially pliant material to allow it to be easily wound and unwound about elongate body 13 between wound and unwound conditions and is substantially flat. In this regard, lanyard 12 includes first and second major surfaces 16 and 17 and first and second side edges 18 and 19.

Figures 4, 5, 6:
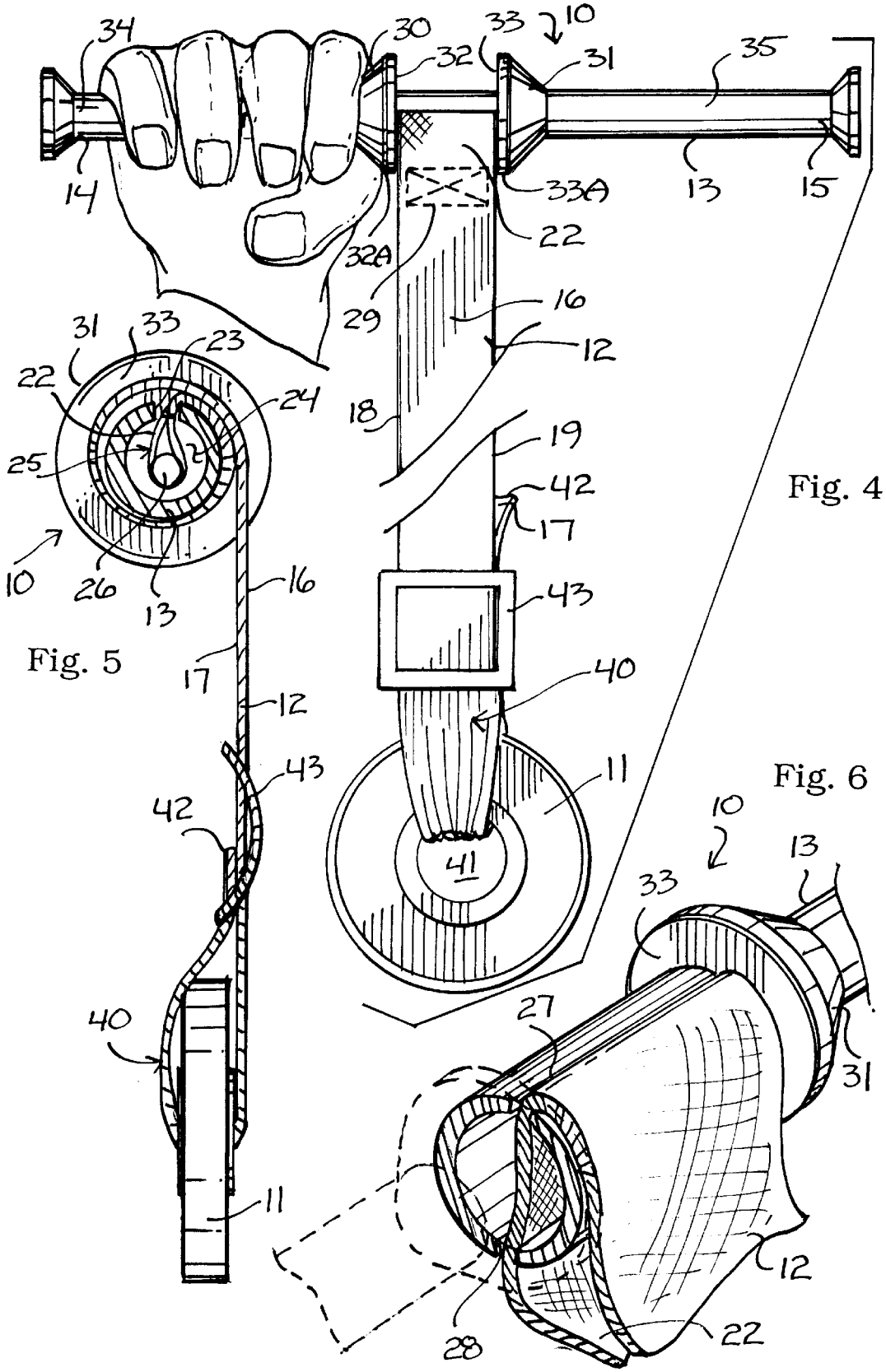
FIG. 4 is a front elevational view of the exercise apparatus of FIG. 1 shown as it would appear held by a user.
FIG. 5 is a vertical sectional view of the elongate body of the exercise apparatus of FIG. 1 with the weight shown carried by the lanyard supported by the elongate body in a specific embodiment.
FIG. 6 is a fragmented perspective view of the elongate body of the exercise apparatus of FIG. 1 with a free end of the lanyard shown extending through slots of the elongate body and then fastened with lanyard in another embodiment.

Regarding FIG. 5, lanyard 12 includes a proximal end 22 fixed to elongate body 13 from which lanyard 12 depends.

Proximal end 22 may be fixed with elongate body in any conventional manner. In this particular embodiment, proximal end 22 extends through a slot 23 leading to a cavity 24 bound by elongate body 13. Proximal end 22 is provided in the form of a loop 25 loopingly engaged with a dowel 26 rigidly supported by elongate body 13 in cavity 24. In another embodiment as shown in FIG. 6, elongate body 13 may be provided with openings or slots 27 and 28 formed therethrough in spaced-apart and substantially opposing relation. To fasten lanyard 12 with elongate body 13 in this embodiment, proximal end 22 may be inserted into and through slots 27 and 28 and then fastened with lanyard 12. Proximal end 22 may be fastened with lanyard by conventional stitching techniques as evinced, for instance, by the box stitch 29 shown in FIGS. 1 and 4.

Elongate body 13 carries first and second stops 30 and 31 each in substantially abutting relation against one of the first and second side edges 18 and 19 of lanyard 12. In particular, and with attention directed to FIG. 4, first stop 30 includes an abutting surface 31 facing first side edge 18 in substantially abutting relation, and second stop 32 includes an abutting surface 33 facing second side edge 19 in substantially abutting relation. Abutting surfaces 32 and 33 oppose one another in spaced relation, reside in substantially parallel planes and are each substantially planar. Abutting surfaces 32 and 33 are each also continuous and terminate outwardly with continuous edges 32A and 33A, respectively, at a point spaced from elongate body 13. Continuous edges 32A and 33A each define a diameter greater than the diameter of elongate body 13 at the point where lanyard 12 is moved between wound and unwound conditions so as to substantially contain lanyard 12 therebetween in the wound condition.

Elongate body 13 includes a handle 34 intermediate first stop 20 and first end 14 and another handle 35 intermediate second stop 21 and second end 15. In operation, a user may grasp, such as with one or more of his or her hands, one or more of handles 34 and 35 and rotate elongate body 13 to move weight in reciprocal directions to raise and lower weight 11 as lanyard 12 is wound and unwound about elongate body 13. It will be understood that the user may support apparatus 10 at a variety of positions relative his or her body for effecting resistance training of the hand, wrist, arm and shoulder muscles. With abutting surfaces 32 and 33 in substantially abutting relation against the first and second side edges 18 and 19, respectively, first and second stops 30 and 31 cooperate to constrain and force lanyard 12 to wind and unwind about elongate body 13 upon itself as substantially shown in FIG. 5. The flatness of lanyard 12 is desirable as it allows lanyard 12 to easily wind and unwind upon itself.

Because first and second stops 30 and 31 force lanyard 12 to wrap upon itself, weight 11 is supported precisely along a linear path relative elongate body 13 as it reciprocates up and down as lanyard 12 is wound and unwound about elongate body 13. This is important because if lanyard 12 were to wind and unwind beside itself, it would cause weight 11 to move laterally or otherwise migrate toward one of the first and second ends 14 and 15 as it is moved in reciprocal directions thereby altering the balance of the weight 11 as supported by elongate body 13. This imbalance can cause user injury or discomfort during use. With first and second stops 30 and 31 operative for forcing lanyard 12 to wind and unwind upon itself, weight 11 is prevented from moving laterally or otherwise migrating toward one of the first and second ends 14 and 15 of elongate body 13. This ensures that weight 11 is precisely balanced relative elongate handle 13 during use which enhances user comfort and substantially inhibits injury that can otherwise occur if the balance of weight 11 as supported by elongate body 13 were to vary during its movement in reciprocal directions.

Weight 11 is normally removably carried by lanyard 12 so that it may be easily removed and replaced as needed with one or more similar weights for varying the weight as desired by a user. As shown in FIGS. 1, 2, 4 and 5, weight 11 is shown supported by a loop 40 of lanyard 12. In particular, weight 11 includes a hole 41 extending therethrough through which a distal or free end 42 of lanyard 12 extends. Free end 42 is in turn fastened with lanyard 12 with a conventional buckle 43 to form loop 40. As an alternative, a carabiner 44 may be supported by loop 40 as an alternative means for removably supporting a weight with lanyard 12. Other conventional mechanisms suitable for providing the removable engagement of one or more weights with lanyard 12 may be used as desired.

The present invention has been described above with reference to a preferred embodiment. However, those skilled in the art will recognize that changes and modifications may be made in the described embodiments without departing from the nature and scope of the present invention. Various changes and modifications to the embodiment herein chosen for purposes of illustration will readily occur to those skilled in the art. To the extent that such modifications and variations do not depart from the spirit of the invention, they are intended to be included within the scope thereof which is assessed only by a fair interpretation of the following claims.

Having fully described the invention in such clear and concise terms as to enable those skilled in the art to understand and practice the same, the invention claimed is:

What is claimed is:

1. Exercise apparatus comprising:

first and second stops carried by an elongate body, the first and second stops defining opposing surfaces separated by a distance; and a lanyard having a first end engaged to the elongate body between the surfaces, a second end engagable to a weight and a width that is substantially constant from the first end to the second end and substantially equal to the distance between the surfaces, the lanyard movable between unwound and wound conditions in response to rotation of the elongate body, wherein the distance between the surfaces and the width of the lanyard cooperate to force the lanyard to roll only upon itself between the surfaces in the wound condition of the lanyard.

2. Exercise apparatus of claim 1, wherein the surfaces face the lanyard.

3. Exercise apparatus of claim 1, wherein each of the surfaces is substantially planar.

4. Exercise apparatus of claim 1, wherein the surfaces define substantially parallel planes.

5. Exercise apparatus of claim 1, wherein the elongate body includes handles each located on either side of one of the first and second stops.

6. Exercise apparatus comprising:

stops carried by an elongate body, the stops defining opposing surfaces separated by a distance; and a lanyard having a first end engaged to the elongate body between the surfaces, a second end supporting a weight and a width that is substantially constant from the first end to the second end and substantially equal to the distance between the surfaces, the lanyard movable between unwound and wound conditions in response to rotation of the elongate body, wherein the distance between the surfaces and the width of the upon itself between the surfaces in the wound condition of the lanyard.

7. Exercise apparatus of claim 6, wherein the surfaces face the lanyard.

8. Exercise apparatus of claim 6, wherein each one of the surfaces is substantially planar.

9. Exercise apparatus of claim 6, wherein the surfaces define substantially parallel planes.

10. Exercise apparatus of claim 6, wherein the elongate body includes handles each located on either side of one of the stops.

11. Exercise apparatus of claim 6, wherein the weight is removably supported by the second end of the lanyard.

12. Exercise apparatus comprising:

an elongate body having ends;

stops carried by the elongate body between the ends, the stops defining opposing surfaces separated by a distance; and a lanyard having a first end engaged to the elongate body between the surfaces, a second end engagable to a weight and a width that is substantially constant from the first end to the second end and substantially equal to the distance between the surfaces, the lanyard movable between unwound and wound conditions in response rotation of the elongate body, wherein the distance between the surfaces and the width of the lanyard cooperate to force the lanyard to roll only upon itself between the surfaces in the wound condition of the lanyard.

13. Exercise apparatus of claim 12, wherein the surfaces face the lanyard.

14. Exercise apparatus of claim 12, wherein each one of the surfaces is substantially planar.

15. Exercise apparatus of claim 12, wherein the surfaces define substantially parallel planes.

16. Exercise apparatus of claim 12, wherein the elongate body includes handles each located on either side of one of the stops.

17. Exercise apparatus of claim 12, wherein the second end of the lanyard is removably engagable to the weight.

* * * * *

UNITED STATES PATENT AND TRADEMARK OFFICE

CERTIFICATE OF CORRECTION

PATENT NO. : 6,099,437
DATED : August 8, 2000
INVENTOR(S) : Demers. Travis G.

It is certified that error appears in the above-identified patent and that said Letters Patent is hereby corrected as shown below:

Column 5,
Line 1, insert -- lanyard cooprate to force the lanyard to roll only -- between "the" and "upon".

Signed and Sealed this

Twenty-eighth Day of August, 2001

*Attest:*

Nicholas P. Godici

*Attesting Officer*

NICHOLAS P. GODICI
*Acting Director of the United States Patent and Trademark Office*